US007997983B2

(12) United States Patent
Marks et al.

(10) Patent No.: US 7,997,983 B2
(45) **Date of Patent: *Aug. 16, 2011**

(54) SLOT MACHINE GAME HAVING A PLURALITY OF WAYS TO ISSUE A PERCENTAGE OF A PROGRESSIVE AWARD BASED UPON ANY WAGER LEVEL ("PERCENTAGE PROGRESSIVE")

(75) Inventors: Daniel M. Marks, Washington, DC (US); Anthony M. Singer, Ringwood, NJ (US); Howard M. Marks, Scarsdale, NY (US)

(73) Assignee: IGT, Reno, NV (US)

( * ) Notice: Subject to any disclaimer, the term of this patent is extended or adjusted under 35 U.S.C. 154(b) by 722 days.

This patent is subject to a terminal disclaimer.

(21) Appl. No.: 12/054,268

(22) Filed: Mar. 24, 2008

(65) Prior Publication Data

US 2008/0207298 A1 Aug. 28, 2008

Related U.S. Application Data

(63) Continuation of application No. 10/438,323, filed on May 15, 2003, now Pat. No. 7,357,716.

(60) Provisional application No. 60/380,485, filed on May 15, 2002.

(51) Int. Cl.
*A63F 9/24* (2006.01)

(52) U.S. Cl. ..... 463/27; 463/20; 463/25

(58) Field of Classification Search ..... 463/12, 463/16–18, 20, 21, 25–28

See application file for complete search history.

(56) References Cited

U.S. PATENT DOCUMENTS

| | | | |
|---|---|---|---|
| 4,838,552 | A | 6/1989 | Hagiwara |
| 5,275,400 | A | 1/1994 | Weingardt et al. |
| 5,564,700 | A | 10/1996 | Celona |
| 5,697,843 | A | 12/1997 | Manship et al. |
| 5,851,148 | A | 12/1998 | Brune et al. |
| 6,089,980 | A | 7/2000 | Gauselmann |

(Continued)

FOREIGN PATENT DOCUMENTS

AU 2007203506 8/2007

(Continued)

OTHER PUBLICATIONS

U.S. Appl. No. 60/350,051 by Vancura et al., filed Jan. 24, 2002 and referenced by U.S. Published Patent Application Publication No. 2003/0181231.

*Primary Examiner* — David L Lewis
*Assistant Examiner* — Robert Mosser
(74) *Attorney, Agent, or Firm* — K&L Gates LLP

(57) ABSTRACT

A slot machine issues a percentage of one or more progressive awards based upon any wager level ("Percentage Progressive"). In a preferred embodiment of the present invention, the Percentage Progressive concept operates as follows: The game displays the total progressive award amount; The player sets the wager; The game displays a Percentage Progressive value based upon the wager level; The player presses the spin button; The reels to spin and stop; The player collects credits for any winning combinations appearing on the reels, including pay table and progressive awards. In the event of a progressive award, the player receives the Percentage Progressive value * total progressive award amount. The preferred embodiment of the present invention, therefore, allows players to participate in progressive awards at any wager level.

17 Claims, 5 Drawing Sheets

U.S. PATENT DOCUMENTS 6,394,902 B1 5/2002 Glavich et al.
6,443,452 B1 9/2002 Brune
6,509,889 B2 * 1/2003 Kamper et al. ..... 345/157
6,626,758 B1 9/2003 Parham et al.
6,913,532 B2 7/2005 Baerlocher et al.
6,955,600 B2 10/2005 Glavich et al.
7,066,814 B2 6/2006 Glavich et al.
7,258,611 B2 8/2007 Bigelow et al.
2003/0181231 A1 9/2003 Vancura et al.

FOREIGN PATENT DOCUMENTS

GB 2148037 5/1985

* cited by examiner

SLOT MACHINE GAME HAVING A PLURALITY OF WAYS TO ISSUE A PERCENTAGE OF A PROGRESSIVE AWARD BASED UPON ANY WAGER LEVEL ("PERCENTAGE PROGRESSIVE")

PRIORITY CLAIM

This application is a continuation of, claims priority to and the benefit of U.S. patent application Ser. No. 10/438,323, filed on May 15, 2003, now U.S. Pat. No. 7,357,716, which is a non-provisional application of, claims priority to and the benefit of U.S. Provisional Patent Application Ser. No. 60/380,485 filed on May 15, 2002, the entire contents of which are incorporated herein.

BACKGROUND OF THE INVENTION

1. Field of Invention

This invention relates generally to payout methods in a mechanical, an electro-mechanical and/or computer-based slot machine-like games-of-chance.

2. Background Description

To play a slot machine, the player deposits money in the form of coins, gaming tokens or paper currency either into a coin head or bill acceptor. The coins and gaming tokens are collected in a reservoir inside the gaming machine while the paper currency is collected in the bill acceptor inside the gaming machine. If the coins, gaming tokens or paper currency are validated as authentic, the player accrues the appropriate number of playing credits on a credit meter. For example, a twenty-five cent gaming machine will accrue four credits for each dollar deposited into the gaming machine.

After accruing credits on the credit meter, the player determines how many credits he wishes to wager on the next spin of the slot reels. After setting the wager, the player spins the reels by pressing the spin button or by pulling a handle. When the reels stop spinning, symbols are displayed on the slot reels ("symbol matrix"). The player then collects credits for any predetermined symbol combinations ("winning combinations"), according to a fixed, pre-determined schedule ("pay table") or a variable, escalating value ("progressive"). More specifically, the slot machine operates as follows:

Symbol Matrix. Slot symbols are displayed on 3 or more slot reels (also called "columns") placed adjacent to each other. Each column contains at least 3 rows, with a symbol in each row. The resulting matrix of symbols ("symbol matrix") typically ranges from 3 columns by 3 rows with 9 total symbols to 5 columns by 3 rows with 15 total symbols. Within the symbol matrix, positions on the slot reels may be referred to according to column, from left to right, and row, from the top to bottom ("symbol positions"). For example: symbol position 1/1 is located in column 1 (i.e., left-most column) and row 1 (i.e., top row).

Winning Combinations. Players collect credits for predetermined winning symbol combinations that appear in specific locations ("pay lines") on the slot reels. Winning combinations typically require that three or more of the same symbols appear adjacent to each other starting from the leftmost position of a pay line ("line pays"). For example: a player may collect a line pay if 3 Banana symbols appeared in symbol positions 1/1, 2/1, 3/1 on a pay line using symbol positions 1/1, 2/1, 3/1, 4/1, and 5/1.

Alternatively, players may also collect credits for predetermined winning combinations that appear anywhere on a pay line ("line scatter pays") or anywhere on the slot reels ("reel scatter pays"). For example, a player may collect a line scatter pay if 3 Banana symbols appeared in symbol positions 1/1, 3/1, 5/1 on a pay line using symbol positions 1/1, 2/1, 3/1, 4/1, and 5/1; and collect a reel scatter pay if 3 Banana symbols appeared anywhere on the slot reels.

Pay Table. Credits are awarded for most winning symbol combinations based on a fixed, predetermined schedule ("pay table"). For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect ten times the amount indicated on the pay table for a reel scatter pay appearing on anywhere on the slot reels.

Progressive. Credits are also awarded for special winning symbol combinations based on a variable, escalating value ("progressive"). The value escalates with each bet placed on the machine ("stand-alone progressive) and/or with each bet placed on a group of associated machines ("linked progressive") in the same casino ("local linked progressive") or across multiple casinos ("wide area linked progressive").

To collect the progressive award, the player must wager a pre-determined number of credits, with the typical game requiring the maximum wager. For example, a player must wager 45 credits, on a game with 9 pay lines and a maximum wager of 5 credits per pay line, to collect the progressive award. If the player does not wager the pre-determined amount, the player may collect a smaller fixed number of credits or nothing at all for the winning combination.

Following any type of pay (e.g., pay table or progressive award), the credits won are added to the player's balance of credits shown in the credit meter. As long as the player has credits on the credit meter, the player may continue to play the gaming machine or the player may collect the remaining balance of credits by pressing a Cash Out button the gaming machine. In addition, the player may view the rules of the game by pressing the Help button before any spin.

A conventional slot machine, therefore, limit players, casinos and manufacturers, as follows:

Players suffer from the boredom of playing "new" games with different graphics, but really use same "old" awards;

Casinos suffer from the players' dissatisfaction with the casino's game selection as they cannot distinguish their game offerings from other casinos; and Game manufacturers suffer declining orders as they cannot distinguish their product line from the other manufacturers.

It is an object of the present invention to, for example, address the limitations associated with conventional slot machines by creating additional methods of issuing progressive awards ("Percentage Progressive"). The Percentage Progressive concept creates a slot game with a wider variety of awards which benefits all parties: the game manufacturer adds a unique product to their sales line; the casino attracts and retains players interested in playing an innovative slot game; and the player enjoys a new method of receiving an award.

SUMMARY OF THE INVENTION

The present invention includes a variety of methods of play that, for example, can be programmed on an electronic video slot machine to issue a percentage of one or more progressive awards based upon any wager level ("Percentage Progressive").

In a preferred embodiment of the present invention, the Percentage Progressive concept operates as follows:

- The game displays the total progressive award amount;
- The player sets the wager;
- The game displays a Percentage Progressive value based upon the wager level;
- The player presses the spin button;
- The reels to spin and stop;
- The player collects credits for any winning combinations appearing on the reels, including pay table and progressive awards.
- In the event of a progressive award, the player receives the Percentage Progressive value * (multiplied by) the total progressive award amount.

The preferred embodiment of the present invention, therefore, allows players to participate in progressive awards at any wager level.

Alternatively, the present invention allows for many other embodiments, including but not limited to the following:

- Any method of calculating percentage. The present invention allows for any method of calculating the Percentage Progressive, including: a fixed formula accounting for each pay line selected, each credit bet per pay line selected, and/or total credits wagered; a variable formula accounting for the total wager plus a random factor, such as input from the player or third party; and/or at random.
- Any method displaying the percentage. The present invention allows for any method of displaying the Percentage Progressive, including: a value displayed on the main screen or secondary screen; a bar graph, line graph, pie chart, or other graphic representation of a value; a physical or video wheel, globe, or other object that rotates and displays a value; a grid of X-rows by Y-columns with each grid position containing a hidden value that is displayed upon selection by a player, third party and/or at random; and/or any other method of indicating a value to a player.
- Any method of triggering the percentage. The present invention allows for any method of triggering the Percentage Progressive, including: line pay combination, such as five jackpot symbols on a selected pay line; line scatter pay combination, such as three Jackpot symbols anywhere on a pay line; a reel scatter pay combination, such as five Jackpot symbols anywhere on the reels.

In addition to the conventional winning combinations, Percentage Jackpots can be triggered using alternative methods, including: Any Lines concept, such as five adjacent Jackpot symbols; Bonus Line concept, such as five tagged Jackpot symbols anywhere on the reels; and/or any other method of issuing awards for slot machines.

- Any number of progressive awards. The present invention allows for issuing Percentage Progressives of any number of awards, including the same progressive award for one or more winning combinations; a different progressive award for each of the one or more winning combinations; and/or multiple progressive awards for each of one or more winning combinations.
- Any type of progressive award. The present invention allows for issuing Percentage Progressives of any type of award, including: number of credits, amount of products, number of free spins, and/or amount of services.

All of these alternative embodiments rely upon the underlying Percentage Jackpot concept that issues a percentage of one or more progressive awards based upon any wager level player.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other systems and methods for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The Detailed Description including the description of a preferred structure as embodying features of the invention will be best understood when read in reference to the accompanying figures wherein.

The same reference numerals refer to the same parts through the various figures.

DETAILED DESCRIPTION OF A PREFERRED EMBODIMENT OF THE INVENTION

Figure 1A:
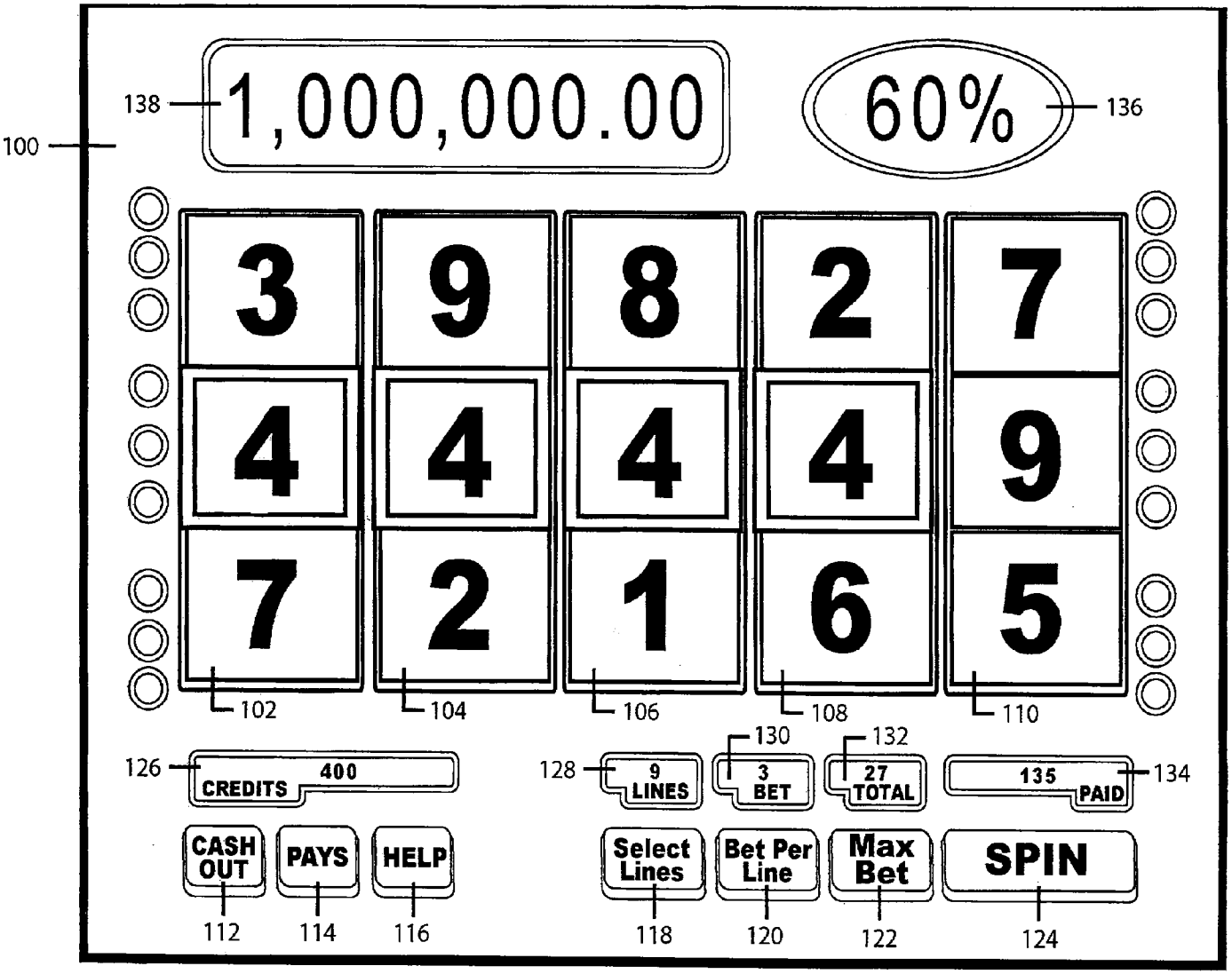
FIGS. 1*a*-1*c* show illustrative examples of representative displays that may be encountered during a typical game in accordance with the principles of the present invention.

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

Percentage Progressive

The preferred embodiment of the present invention includes the play of the base game with Percentage Progressive concept, as described below:

To play the game, the player establishes a pool of credits, selects pay lines, sets the wager per pay line, spins the reels, and collects fixed pay table and/or progressive awards for winning symbol combinations.

Video Display. FIG. 1 shows the base game screen 100, including five-reel display using a 5-column by 3-row symbol matrix. The first column 102, second column 104, third column 106, fourth column 108 and fifth column 110 all hold three symbols. Alternatively, the game could utilize any number of columns and reels, such as a 3-column by 3-row symbol matrix.

Buttons. FIG. 1 shows a set of control buttons 112-124 on the base game screen 100. The player uses the buttons to control the functions of the slot game. These buttons include Cash Out 112, Pays 114, Help 116, Select Pay Lines 118, Bet Per Line 120, Max Bet 122, and Spin 124. Any or all of these control buttons may be displayed on the video display and/or buttons hard wired to the gaming device. If necessary, any number of buttons may be added to further facilitate control of the game.

Meters. FIG. 1 shows a set of meters 126-136 on the base game screen 100. The meters are used to display the salient information for the game, including Credits 126, Number of Pay Lines 128, Amount Bet Per Line 130, Total Bet 132, Paid 134, Percentage Progressive 136, and Progressive Award 138:

The Credits meter 126 which displays the total number credits remaining in the credit pool.

The Number of Pay Lines meter 128 is associated with the Select Pay Lines button 118 and displays the current number of Pay Lines Selected.

The Amount Bet Per Line 130 meter is associated with the Bet Per Line button 120 and displays the number of credits wagered per pay line.

The Total Bet 132 meter displays the cumulative value of the Number of Pay Lines and Amount Bet Per Line.

The Paid meter 134 displays the number of credits won on the last spin.

The Percentage Progressive meter 136 displays the percentage value of the progressive award that will be issued to the player.

The Progressive Award meter 138 displays the total value of the progressive award.

If necessary, any number of meters may be added to further facilitate control of the game.

Figure 2:
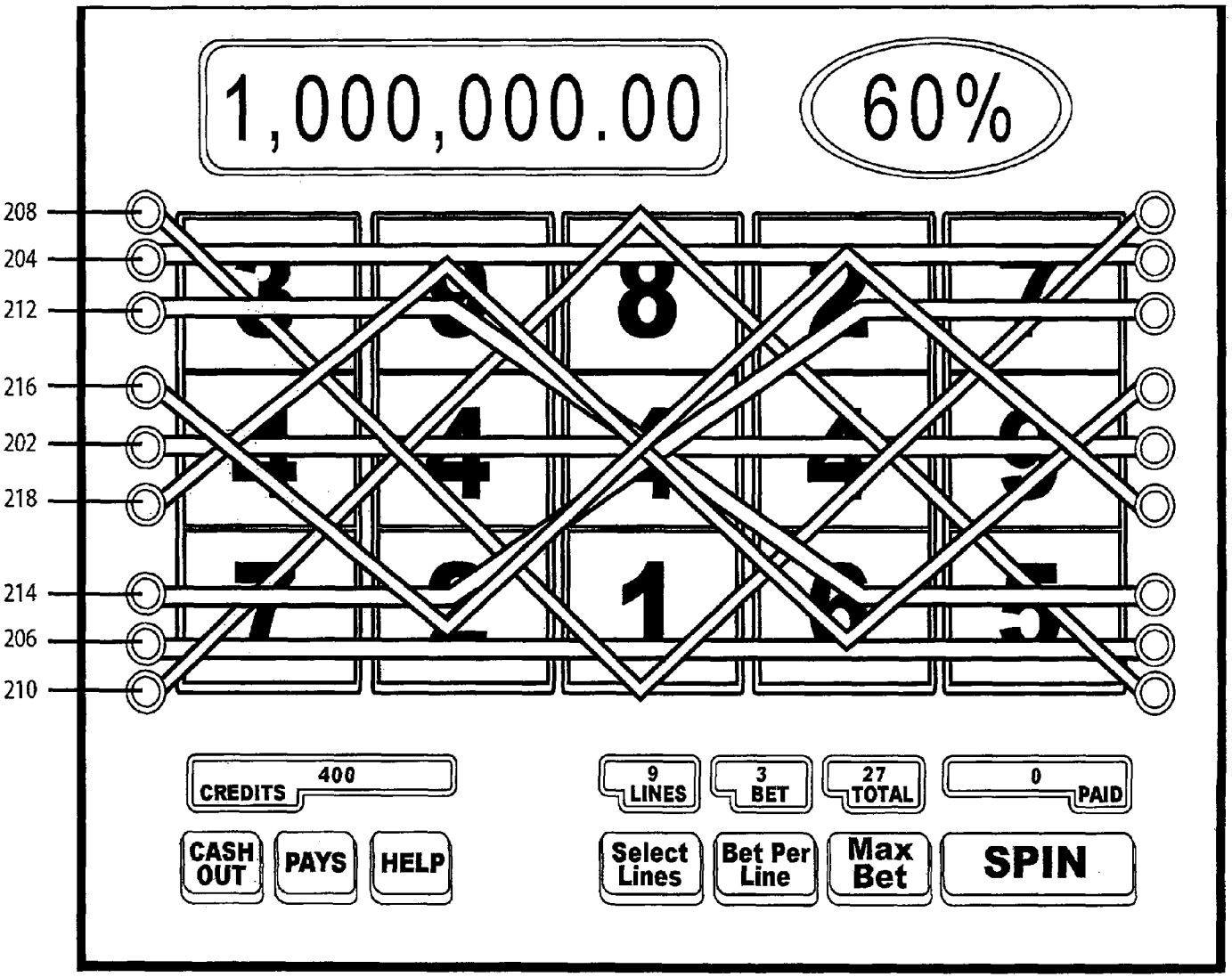
FIG. 2 shows illustrative examples of representative pay lines that may be wagered upon during a typical game in accordance with the principles of the present invention.

Select Pay Lines. FIG. 2 shows the plurality of pay lines 202-218 upon which to wager. The pay lines wagered upon by the player activate in a predetermined order, as follows: Pay line 1 at 202; Pay line 2 at 204; Pay line 3 at 206; Pay line 4 at 208; Pay line 5 at 210; Pay line 6 at 212; Pay line 7 at 214; Pay line 8 at 216; and Pay line 9 at 218.

However, the games may utilize any other order of pay line activation and fewer or greater than nine pay lines may be used.

Bet Per Line. FIGS. 2*a*-2*i* show the number of credits in wagered on each pay line, as displayed on the Bet Per Line meter 130. The player may wager up to five credit per pay line with same amount is wagered on each pay line. Alternatively, the player may wager any amount on each pay line and/or make wagers of different amounts on each pay line.

Total Bet. FIGS. 6*a-i* show the total number of credits bet on all of the pay lines, as displayed on the Total Bet meter 132. The total bet is calculated by multiplying the value of the Number of Pay Lines meter 128 by the Bet Per Line meter 130.

Symbol Set. In the preferred embodiment, the symbol set contains three different types of symbols: line pay, scatter pay, and wild symbols.

Line Pay Symbols: One or more line pay symbols may be used to form winning combinations along any selected pay line. For example, a Cherry-Cherry-Cherry combination.

In the preferred embodiment of the present invention, there are 9 line pay symbols (i.e. 1, 2, 3, 4, 5, 6, 7, 8, and 9). If any 3 or more same line pay symbols appear on a selected pay line, starting from the leftmost column to the right, the game issues a pay table award.

Scatter Pay Symbols: One or more scatter pay symbols may be used to form winning combinations along any pay line (i.e. line scatter pay) and/or anywhere in the symbol matrix (i.e. reel scatter pay). For example, three Cherry symbols appearing anywhere on a selected pay line or anywhere in the symbol matrix.

In the preferred embodiment of the present invention, there is one scatter symbol (i.e. Jackpot or JP). If two to four JP scatter symbols appear anywhere in the symbol matrix issues a pay table award. If 5 or more JP scatter symbols appear anywhere in the symbol matrix, however, the game issues a progressive award using the Percentage Progressive concept.

Wild Symbols. Wild symbols may be used to replace any or all other symbols to help form winning symbol combinations. For example, in a Cherry-Wild-Cherry combination the wild symbol would act as a Cherry symbol to form a Cherry-Cherry-Cherry combination. In addition, a wild symbol used in a winning combination may increase, decrease, or have no effect on the value of that combination. For example, a wild symbol may double the value of a symbol combination.

In the preferred embodiment of the present invention, there is one wild symbol (i.e. W). A wild symbol replaces any base symbol, but does not replace the "JP" scatter symbol. Furthermore, a wild symbol used to help form a winning combination does not affect the value of that combination.

Alternatively, the symbol set may be composed of any number of symbols and/or any type of symbols.

Figure 1B:
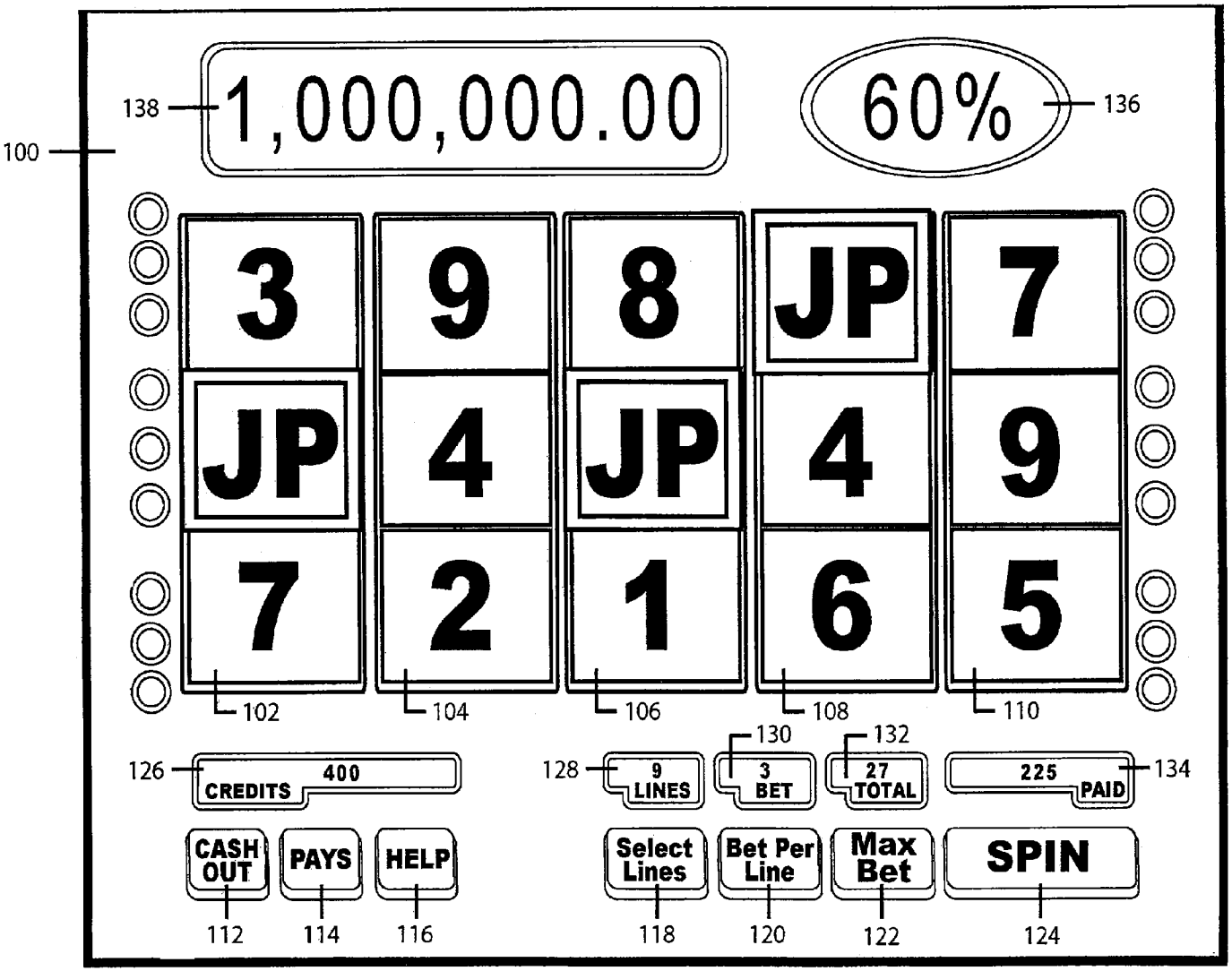
Figure 1C:
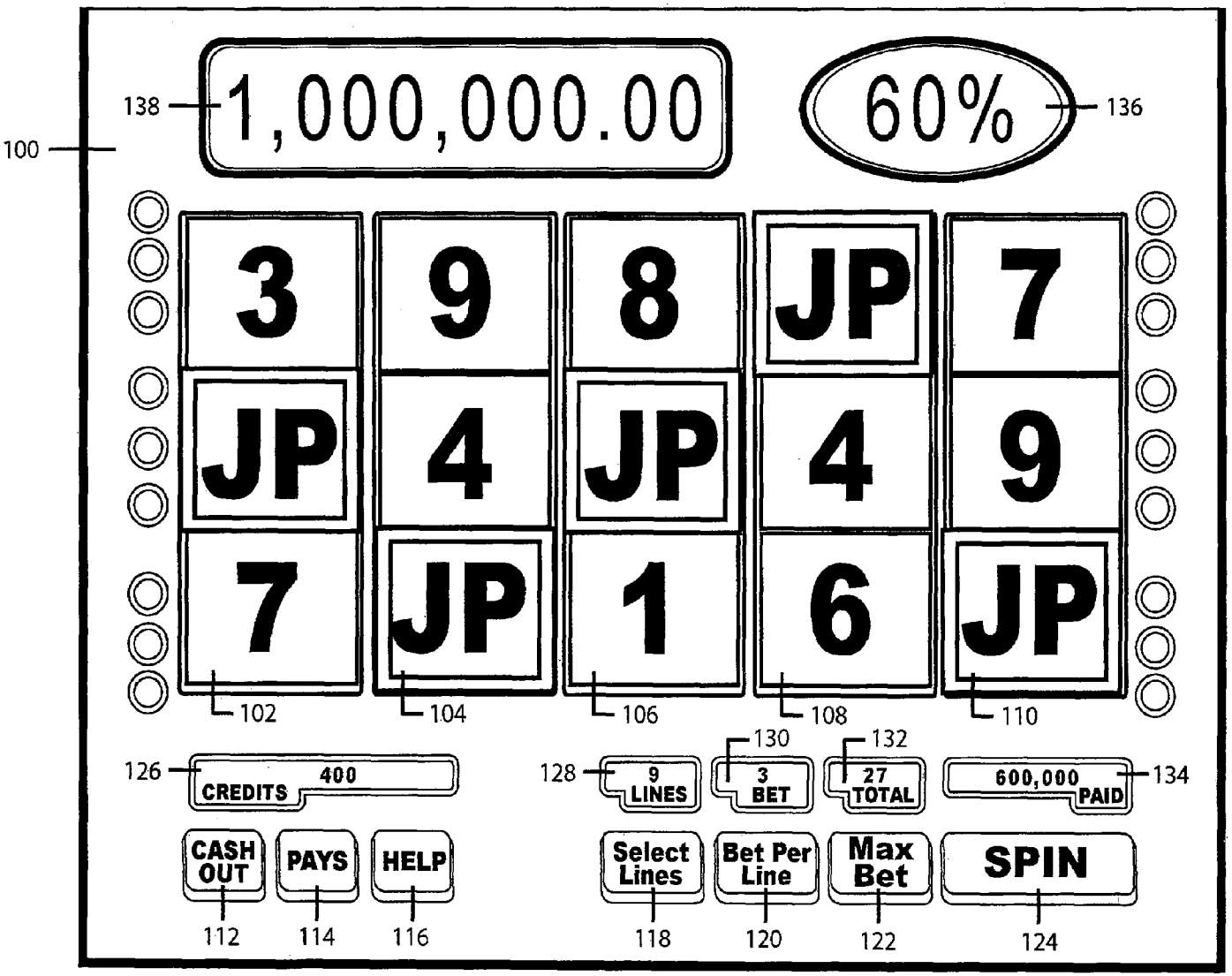

Winning Symbol Combinations. FIGS. 1*a-c* show winning symbol combinations, including line pay 1*a*, scatter pay with a pay table award 1*b*, and a scatter pay with a progressive award 1*c:*

FIG. 1*a* shows a line pay of four "4" symbols on pay line 1 at 202. The line pay results in a pay table award of 135 credits as shown on the Paid meter 134.

FIG. 1*b* shows a scatter pay of three JP symbols on slot reels 102, 106, and 108. The scatter pay results in a pay table award of 225 credits as shown on the Paid meter 134.

FIG. 1*c* shows a scatter pay of five JP symbols on the slot reels 102, 104, 106, 108, and 110. The scatter pay results in a progressive award of $600,000, as calculated by multiplying the Percentage Progressive meter 136 (i.e. 60%) by the Progressive Award meter 138 (i.e. $1,000,000).

Alternatively, any pre-determined arrangement of symbols may be designated as winning symbol combinations with any pay table and/or progressive award using the Percentage Progressive concept.

Pay Table Awards. FIGS. 1*a* and 1*b* show the pay table awards based on the following schedule:

| | | |
|---|---|---|
| 9-9-9-9-9 . . . 10000 | 9-9-9-9 . . . 500 | 9-9-9 . . . 150 |
| 8-8-8-8-8 . . . 1000 | 8-8-8-8 . . . 300 | 8-8-8 . . . 100 |
| 7-7-7-7-7 . . . 500 | 7-7-7-7 . . . 150 | 7-7-7 . . . 50 |
| 6-6-6-6-6 . . . 400 | 6-6-6-6 . . . 75 | 6-6-6 . . . 25 |
| 5-5-5-5-5 . . . 250 | 5-5-5-5 . . . 60 | 5-5-5 . . . 20 |
| 4-4-4-4-4 . . . 150 | 4-4-4-4 . . . 45 | 4-4-4 . . . 15 |
| 3-3-3-3-3 . . . 100 | 3-3-3-3 . . . 30 | 3-3-3 . . . 10 |
| 2-2-2-2-2 . . . 50 | 2-2-2-2 . . . 15 | 2-2-2 . . . 5 |
| 1-1-1-1-1 . . . 30 | 1-1-1-1 . . . 10 | 1-1-1 . . . 3 |

* Any 2 "JP" symbols on the reels pays 2 × total bet.

* Any 3 "JP" symbols on the reels pays 15 × total bet.

* Any 4 "JP" symbols on the reels pays 100 × total bet.

** Any 5 "JP" SYMBOLS TRIGGERS PERCENTAGE PROGRESSIVE AWARD; MULTIPLY TOTAL PROGRESSIVE AMOUNT BY PERCENTAGE PROGRESSIVE VALUE.

In FIG. 1*a*, the player wagered 3 credits on each pay line and, therefore, collects 3× the "45" value indicated on the pay table for the winning line pay combination on pay line 1.

In FIG. 1*b*, the player wagered 27 credits on the game and, therefore, collects 2× the total amount wagered, as indicated on the pay table for a scatter pay combination.

Progressive Awards (using Percentage Progressive). FIG. 1*c* shows a $600,000 progressive award using Percentage Progressive concept, calculated as follows:

The progressive award meter 138 indicates the total value of the progressive award at the time of the spin, or $1,000,000.

The progressive award meter 138 increases value with each spin on this machine, or any of the linked machines.

The progressive award value increases at a rate of X % (i.e. X is any positive fraction or integer) of the total value of each bet placed on any of the linked machines.

The progressive award decreases to a predetermined value (and then starts increasing again) each time the progressive issues.

Alternatively, the progressive award may be increase or decrease based on any other acceptable method.

The Percentage Progressive meter 136 indicates a value of "60%" or sixty percent.

The Percentage Progressive value is calculated according to the following formula:

$$U*T+I*\text{int}(U/L)$$

L=Maximum number of pay lines

C=Maximum number of credits per pay line

M=Maximum bet, or L*C

U=Unit multiplier, or the integer value of 100/M

T=Total Bet, or wager placed on this spin of the slot reels

I=Increment, or integer value of (100−U*M)/C

Alternatively, the Percentage Progressive value may be calculated using any other acceptable formula and/or method.

The progressive award is calculated by multiplying the "60%" value displayed in the Percentage Progressive meter 136 by the "$1,000,000" value displayed in the total progressive award meter 138; or, "60%"×"$1,000,000."

Figure 3:
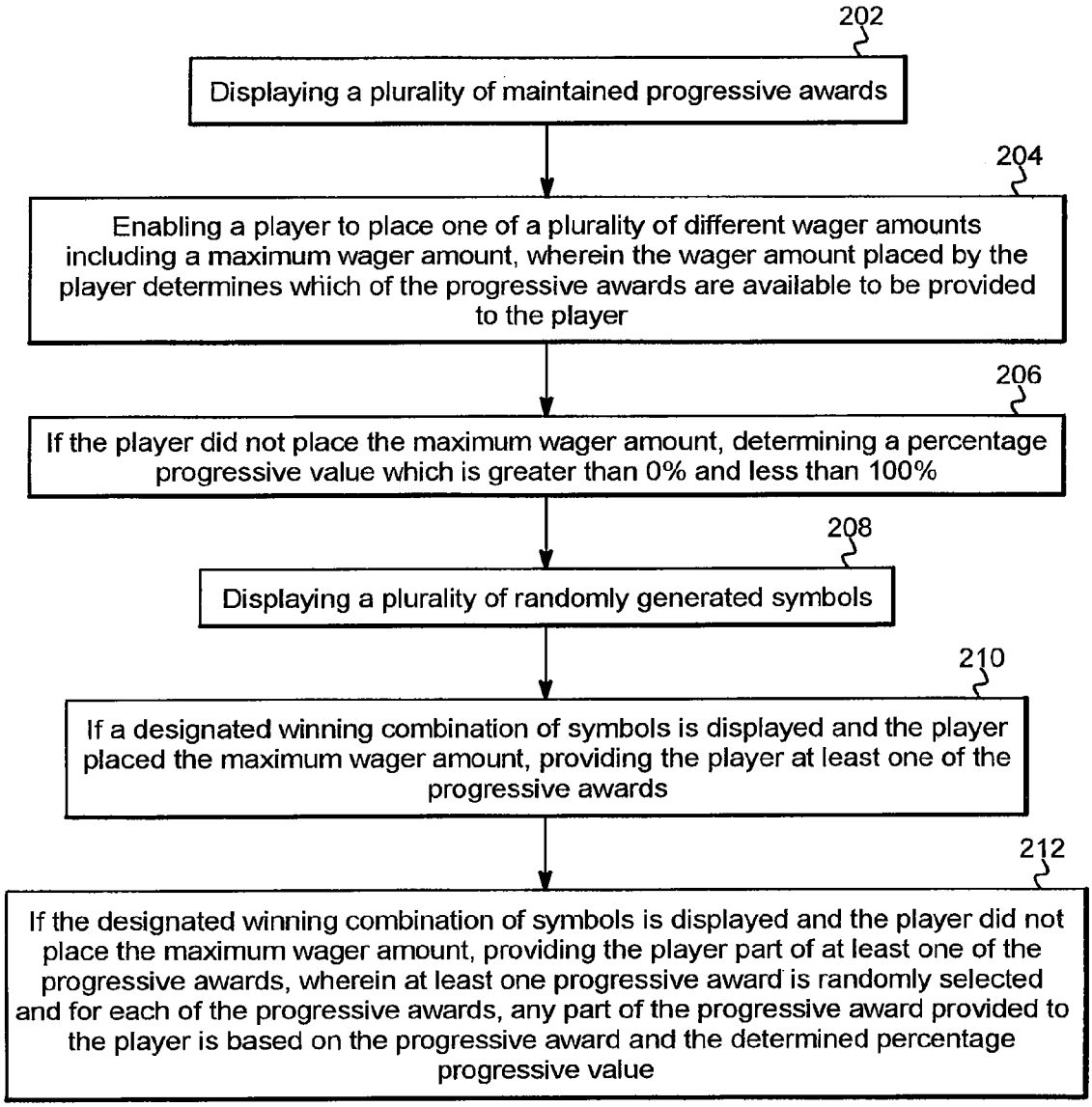
FIG. 3 is a flowchart of one embodiment of the gaming device disclosed herein, illustrating part of at least one progressive award provided to a player if the player did not place the maximum wager amount.

As illustrated in FIG. 3, one embodiment of the gaming device disclosed herein includes, as illustrated in blocks 202 and 204, displaying a plurality of maintained progressive awards and enabling a player to place one of a plurality of different wager amounts including a maximum wager amount, wherein the wager amount placed by the player determines which of the progressive awards are available to be provided to the player. If the player did not place the maximum wager amount, the gaming device includes determining a percentage progressive value which is greater than 0% and less than 100% as indicated in block 206. As seen in block 208, the gaming device also includes displaying a plurality of randomly generated symbols. If a designated winning combination of symbols is displayed and the player placed the maximum wager amount, as indicated in block 210, the gaming device disclosed herein includes providing the player at least one of the progressive awards. If the designated winning combination of symbols is displayed and the player did not place the maximum wager amount, as seen in block 212, the gaming device also includes providing the player part of at least one of the progressive awards, wherein the at least one progressive award is randomly selected and for each of the progressive awards, any part of the progressive award provided to the player is based on the progressive award and the determined percentage progressive value.

The many features and advantages of the invention are apparent from the detailed specification above, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

The invention is claimed as follows:

1. A gaming system comprising:

a display device;

an input device;

a processor; and a memory device which stores a plurality of instructions, which when executed by the processor, cause the processor to operate with the display device and the input device to:

(a) display a single maintained progressive award value;

(b) enable a player to place one of a plurality of different wager amounts, wherein the plurality of different wager amounts includes a designated wager amount;

(c) for each placement of one of the wager amounts:
(i) display a plurality of randomly generated symbols;
(ii) if a designated winning combination of said symbols is displayed and the player placed the designated wager amount, provide the player the single progressive award value; and
(iii) if the designated winning combination of said symbols is displayed and the player did not place the designated wager amount:
(A) after displaying the plurality of randomly generated symbols, enable a third party to make at least one input,
(B) after the third party makes the at least one input, determine a percentage progressive value which is greater than 0% and less than 100%, wherein said determined percentage progressive value is based, at least in part, on the at least one input from the third party, and
(C) display and provide the player part of the single progressive award value, wherein any part of the progressive award provided to the player is based on said single progressive award value and the determined percentage progressive value.

2. The gaming system of claim 1, wherein when executed by the processor, the plurality of instructions cause the processor to determine said percentage progressive value based, at least in part, on the placed wager amount relative to the designated wager amount.

3. The gaming system of claim 1, wherein when executed by the processor, the plurality of instructions cause the processor to determine said percentage progressive value based, at least in part, on at least one selected from the group consisting of:
(A) a quantity of pay lines wagered on,
(B) an amount wagered per pay line,
(C) an amount wagered on each generation of the plurality of symbols,
(D) at least one input from the player, and
(E) at least one random variable.

4. A gaming system comprising:
a display device;
an input device;
a processor; and
a memory device which stores a plurality of instructions, which when executed by the processor, cause the processor to operate with the display device and the input device to:
(a) display a plurality of different maintained progressive awards;
(b) enable a player to place one of a plurality of different wager amounts, wherein the plurality of different wager amounts includes a designated wager amount and the wager amount placed by the player determines which of said progressive awards are available to be provided to the player;
(c) display a plurality of randomly generated symbols;
(d) if a designated winning combination of said symbols is displayed and the player placed the designated wager amount, provide the player at least one of the progressive awards; and
(e) if the designated winning combination of said symbols is displayed and the player did not place the designated wager amount:
(i) determine a percentage progressive value which is greater than 0% and less than 100%, and
(ii) display and provide the player part of at least one of the progressive awards, wherein said at least one progressive award is randomly selected, said random selection of said at least one progressive award occurs distinct from any random generation of the symbols, and for each of said progressive awards, any part of the progressive award provided to the player is based on said progressive award and the determined percentage progressive value.

5. The gaming system of claim 4, wherein when executed by the processor, the plurality of instructions cause the processor to determine said percentage progressive value based on the placed wager amount relative to the designated wager amount.

6. The gaming system of claim 4 wherein when executed by the processor, the plurality of instructions cause the processor to determine said percentage progressive value based on at least one selected from the group consisting of:
(A) a quantity of pay lines wagered on,
(B) an amount wagered per pay line,
(C) an amount wagered on each generation of the plurality of symbols,
(D) at least one input from the player,
(E) at least one input from at least one third party, and
(F) at least one random variable.

7. A gaming system comprising:
a display device;
an input device;
a processor; and
a memory device which stores a plurality of instructions, which when executed by the processor, cause the processor to operate with the display device and the input device to:
(a) display a plurality of maintained progressive awards;
(b) enable a player to place one of a plurality of different wager amounts, wherein said plurality of different wager amounts includes a designated wager amount;
(c) display a plurality of randomly generated symbols;
(d) if a first winning combination of said symbols is displayed and the player placed the designated wager amount, provide the player a first one of the maintained progressive awards;
(e) if a second, different winning combination of said symbols is displayed and the player placed the designated wager amount, provide the player a second, different one of the maintained progressive awards; and
(f) if the first winning combination of said symbols is displayed or the second winning combination of said symbols is displayed and the player did not place the designated wager amount:
(i) determine a percentage progressive value which is greater than 0% and less than 100%,
(ii) display and provide the player part of the first one of the progressive awards if the first winning combination of said symbols is displayed, wherein any part of the first one of the progressive awards provided to the player is based on said first one of the progressive awards and the determined percentage progressive value, and
(iii) display and provide the player part of the second one of the progressive awards if the second winning combination of said symbols is displayed, wherein any part of the second one of the progressive awards provided to the player is based on said second one of the progressive awards and the determined percentage progressive value.

8. A method of operating a gaming system, said method comprising:

(a) displaying a single maintained progressive award value;

(b) enabling one of a plurality of different wager amounts to be placed, wherein the plurality of different wager amounts includes a designated wager amount;

(c) for each placement of one of the wager amounts:

(i) displaying a plurality of randomly generated symbols;

(ii) if a designated winning combination of said symbols is displayed and the designated wager amount was placed, providing the single progressive award value; and (iii) if the designated winning combination of said symbols is displayed and the designated wager amount was not placed:

(A) after displaying the plurality of randomly generated symbols, enabling a third party to make at least one input, (B) after the third party makes the at least one input, determining a percentage progressive value which is greater than 0% and less than 100%, wherein said determined percentage progressive value is based, at least in part, on the at least one input from the third party, and (ii) displaying and providing a player part of the single progressive award value, wherein any part of the progressive award provided is based on said single progressive award value and the determined percentage progressive value.

9. The method of claim 8, which includes determining said percentage progressive value based, at least in part, on the placed wager amount relative to the designated wager amount.

10. The method of claim 8, which includes determining said percentage progressive value based, at least in part, on at least one selected from the group consisting of:

(A) a quantity of pay lines wagered on, (B) an amount wagered per pay line, (C) an amount wagered on each generation of the plurality of symbols, (D) at least one input from the player, and (E) at least one random variable.

11. The method of claim 8, which is operated via a data network.

12. A method of operating a gaming system, said method comprising:

(a) displaying a plurality of different maintained progressive awards;

(b) enabling one of a plurality of different wager amounts to be placed, wherein the plurality of different wager amounts includes a designated wager amount and the wager amount placed determines which of said progressive awards are available to be provided;

(c) displaying a plurality of randomly generated symbols;

(d) if a designated winning combination of said symbols is displayed and the designated wager amount was placed, providing at least one of the progressive awards; and (e) if the designated winning combination of said symbols is displayed and the designated wager amount was not placed:

(i) determining a percentage progressive value which is greater than 0% and less than 100%, and (ii) displaying and providing a player part of at least one of the progressive awards, wherein said at least one progressive award is randomly selected, said random selection of said at least one progressive award occurs distinct from any random generation of the symbols, and for each of said progressive awards, any part of the progressive award provided is based on said progressive award and the determined percentage progressive value.

13. The method of claim 12, which includes determining said percentage progressive value based on the placed wager amount relative to the designated wager amount.

14. The method of claim 12, which includes determining said percentage progressive value based on at least one selected from the group consisting of:

(A) a quantity of pay lines wagered on, (B) an amount wagered per pay line, (C) an amount wagered on each generation of the plurality of symbols, (D) at least one input from the player, (E) at least one input from at least one third party, and (F) at least one random variable.

15. The method of claim 12, which is operated via a data network.

16. A method of operating a gaming system, said method comprising:

(a) displaying a plurality of maintained progressive awards;

(b) enabling one of a plurality of different wager amounts to be placed, wherein said plurality of different wager amounts includes a designated wager amount;

(c) displaying a plurality of randomly generated symbols;

(d) if a first winning combination of said symbols is displayed and the designated wager amount was placed, providing a first one of the maintained progressive awards;

(e) if a second, different winning combination of said symbols is displayed and the designated wager amount was placed, providing a second, different one of the maintained progressive awards; and (f) if the first winning combination of said symbols is displayed or the second winning combination of said symbols is displayed and the designated wager amount was not placed:

(i) determining a percentage progressive value which is greater than 0% and less than 100%, (ii) displaying and providing a player part of the first one of the progressive awards if the first winning combination of said symbols is displayed, wherein any part of the first one of the progressive awards provided is based on said first one of the progressive awards and the determined percentage progressive value, and (iii) displaying and providing the player part of the second one of the progressive awards if the second winning combination of said symbols is displayed, wherein any part of the second one of the progressive awards provided is based on said second one of the progressive awards and the determined percentage progressive value.

17. The method of claim 16, which is operated via a data network.

* * * * *

UNITED STATES PATENT AND TRADEMARK OFFICE

CERTIFICATE OF CORRECTION

PATENT NO. : 7,997,983 B2
APPLICATION NO. : 12/054268
DATED : August 16, 2011
INVENTOR(S) : Daniel M. Marks et al.

It is certified that error appears in the above-identified patent and that said Letters Patent is hereby corrected as shown below:

IN THE CLAIMS:

In Claim 1, column 8, line 67, after “amount;” add --and--.

In Claim 1, column 9, line 21, replace “progressive award” with --single progressive award value--.

In Claim 8, column 11, line 7, after “amount;” add --and--.

In Claim 8, column 11, line 29, replace “progressive award” with --single progressive award value--.

Signed and Sealed this
Thirteenth Day of December, 2011

David J. Kappos

David J. Kappos
*Director of the United States Patent and Trademark Office*